US010944193B2

(12) United States Patent
Meynier et al.

(10) Patent No.: US 10,944,193 B2
(45) Date of Patent: Mar. 9, 2021

(54) MINIATURE, LOW-PITCH COAXIAL MICROWAVE CONNECTOR, INTENDED IN PARTICULAR TO LINK TWO PRINTED CIRCUIT BOARDS TO ONE ANOTHER

(71) Applicant: RADIALL SA, Aubervilliers (FR)

(72) Inventors: Christophe Meynier, Vourey (FR); Laurent Petit, Saint Jean de Moirans (FR)

(73) Assignee: RADIALL SA, Aubervilliers (FR)

( * ) Notice: Subject to any disclaimer, the term of this patent is extended or adjusted under 35 U.S.C. 154(b) by 0 days.

(21) Appl. No.: 16/574,173

(22) Filed: Sep. 18, 2019

(65) Prior Publication Data

US 2020/0091639 A1 Mar. 19, 2020

(30) Foreign Application Priority Data

Sep. 19, 2018 (FR) ..... 1858473

(51) Int. Cl.

| | |
|---|---|
| ***H01R 12/73*** | (2011.01) |
| ***H01R 12/52*** | (2011.01) |
| ***H01R 12/61*** | (2011.01) |
| ***H01R 24/50*** | (2011.01) |

(52) U.S. Cl.

CPC ..... *H01R 12/73* (2013.01); *H01R 12/52* (2013.01); *H01R 12/616* (2013.01); *H01R 24/50* (2013.01)

(58) Field of Classification Search

CPC ..... H01R 24/50; H01R 12/7082; H01R 9/05; H01R 9/15; H01R 12/73; H01R 12/52; H01R 12/616

See application file for complete search history.

(56) References Cited

U.S. PATENT DOCUMENTS

| | | | | |
|---|---|---|---|---|
| 6,699,054 | B1 * | 3/2004 | Critelli | H01R 13/6315 439/248 |
| 6,776,668 | B1 * | 8/2004 | Scyoc | H01R 13/2421 439/295 |
| 7,118,383 | B2 * | 10/2006 | Nagata | H01R 13/6315 439/63 |
| 7,210,941 | B2 * | 5/2007 | Rosenberge | H01R 13/2464 439/63 |

(Continued)

FOREIGN PATENT DOCUMENTS

| | | |
|---|---|---|
| DE | 10 2005 033 911 A1 | 2/2007 |
| FR | 2 994 031 A1 | 1/2014 |

*Primary Examiner* — Briggitte R. Hammond
(74) *Attorney, Agent, or Firm* — Pearne & Gordon LLP

(57) ABSTRACT

A coaxial microwave connector, intended to link two printed circuit boards (PCBs) to one another, of central axis (X) comprising: two connection elements each with a central contact and a ground contact, the ground and central contacts of the second element being free to be displaced, along the axis (X), relative to those of the first element, between a configuration of disconnection, and a configuration of connection in which the elements are intended to establish an electrical ground and central contact between the two PCBs; and at least one flexible electrically insulating washer, which both allows the coaxial mechanical holding between each central contact inside the ground contact of the first or of the second connection element, and makes it possible to establish a mechanical pressure between the end of the central contact and one of the two PCBs.

11 Claims, 6 Drawing Sheets

(56) References Cited

U.S. PATENT DOCUMENTS

| | | | | |
|---|---|---|---|---|
| 7,416,418 | B2 * | 8/2008 | Berthet | H01R 12/91 439/66 |
| 7,934,953 | B1 * | 5/2011 | Solis | H01R 13/622 439/578 |
| 8,303,328 | B2 * | 11/2012 | Meynier | H01R 13/622 439/370 |
| 9,011,163 | B2 * | 4/2015 | Ohsaka | H01R 12/57 439/63 |
| 9,065,186 | B2 * | 6/2015 | Perrin | H01R 12/714 |
| 10,249,968 | B2 * | 4/2019 | Dandl | H01R 12/73 |
| 10,622,765 | B2 * | 4/2020 | Song | H01R 12/714 |
| 2014/0030915 | A1 * | 1/2014 | Perrin | H01R 24/50 439/578 |
| 2020/0091639 | A1 * | 3/2020 | Meynier | H01R 12/73 |

* cited by examiner (STATE OF THE ART)

Fig.8A
(STATE OF THE ART)
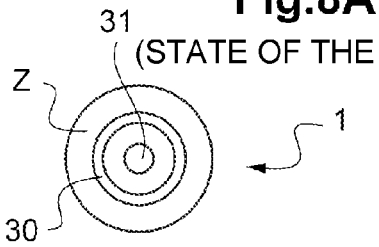
Fig.8B
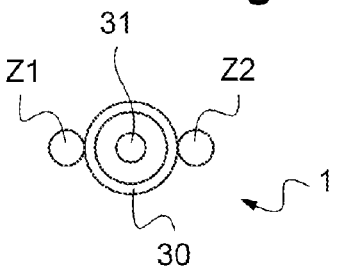
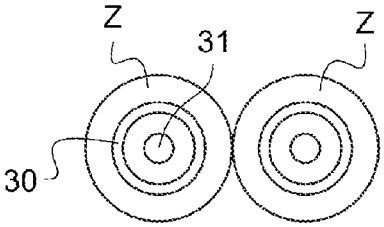
Fig.9A
(STATE OF THE ART)
Fig.9B
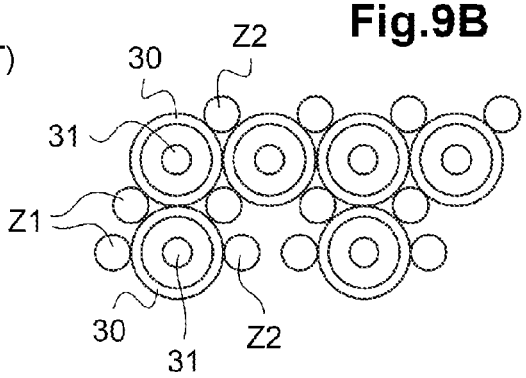
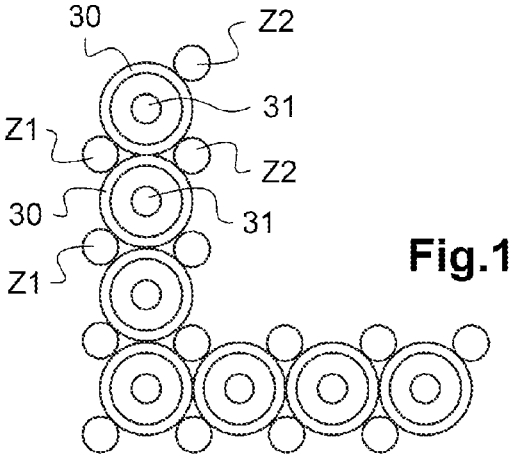
Fig.10

MINIATURE, LOW-PITCH COAXIAL MICROWAVE CONNECTOR, INTENDED IN PARTICULAR TO LINK TWO PRINTED CIRCUIT BOARDS TO ONE ANOTHER

CROSS-REFERENCE TO RELATED APPLICATION

This application claims the benefit of French Application No. 1858473 dated Sep. 19, 2018, the entire disclosure of which is incorporated herein by reference.

TECHNICAL FIELD

The present invention relates to a coaxial microwave connector. Such a connector is intended in particular to link two printed circuit boards (PCB) or even a printed circuit board to another component such as a module or a filter.

"Microwave connector" is understood here, and in the context of the present invention, to mean a connector capable of ensuring the transmission of signals in the range of microwave frequencies, for example at frequencies lying between 1 GHz and 20 GHz, even up to 100 GHz, in particular equal to 40 GHz.

"Contact" is understood here, and in the context of the present invention, to mean an element made of electrically conductive material to allow the passage of electrical current.

STATE OF THE ART

To establish a coaxial link between two printed circuit boards that are parallel and more or less close to one another, coaxial connectors are known, comprising a first cylindrical connector element intended to be fixed, by one end, to a first printed circuit board, and a second cylindrical connector element intended to come into contact, by one end, with a second printed circuit board, each connector element comprising a central contact and an outer contact separated by an insulator, the central and outer contacts of the first and second connector elements comprising cylindrical faces that are mutually in contact, elastic means being interposed between the first and second connector elements and stressing the central and outer contacts of the second connector element toward the second printed circuit board.

The first connector element can be fixed mechanically, in particular by brazing, to a first printed circuit board and the second board is brought to bear against the second connector element which is displaced relative to the first connector element, the contacts of the second connector element being squeezed under the action of the elastic means against the conductive zones provided on the second board. Thus, these elastic means are necessary to obtain an adequate mechanical contact force, guaranteeing a good electrical contact.

Auxiliary means ensure that the second printed circuit board is held in position in proximity to the first printed circuit board, thus preventing the second connection element from being disconnected from the first connection element and from the second printed circuit board.

A connector of this type in which the elastic means are O-ring seals made of elastomer is described in the U.S. Pat. No. 6,699,054. The addition of O-ring seals makes the design of this connector complex.

The patent application DE 102005033911 discloses a connector in which the elastic means are composed of a central helical spring which also constitutes the central contact. One major drawback is that one of the ground contacts in the form of a solid cylinder is not really compressible, which does not guarantee a good electrical ground contact and the absorption of the relatively significant board-to-board tolerances. Furthermore, the central spring induces an excessive inductance, unsuitable for microwave transmission of signals.

The U.S. Pat. No. 7,416,418 discloses a coaxial microwave connector, called board-to-board connector, in which a first spring element is inserted axially between the conductive rods of the connection elements. A second spring is inserted axially between the conductive bodies of the connection elements. The first connector element is fixed to the first printed circuit board. When the second printed circuit board is brought against the second connection element, the springs push back the rod and the body of the second connector element against the second printed circuit board, opposite the first connector element, so as to ensure a satisfactory electrical contact between the second connector element and the second printed circuit board. The structure of this connector remains relatively complex.

To dispense with the drawback associated with the use of two springs of the U.S. Pat. No. 7,416,418, the applicant has proposed, in the patent application FR2994031, a novel coaxial microwave connector of simpler structure.

Embedded applications require board-to-board connection solutions with maximum integration densities while being of lighter weight.

Moreover, the existing coaxial connectors for board-to-board applications are not designed to have significant tolerances in displacement and in compression within a wide height range.

Now, the inventors were faced with a need for a coaxial microwave connector to link two printed circuit boards, separated by a board-to-board distance (height) that can lie between 3 and more than 20 mm, typically less than 1.5 mm, with tolerances on the distance between boards possibly as high as 30% of this distance.

In addition to the abovementioned drawbacks, most of the known coaxial connectors for board-to-board links require a brazing process to fix each of the longitudinal ends of the connectors to a PCB. This solution is unsatisfactory, particularly when a large number of connections is necessary, because it requires excessively high alignment accuracies and involves mechanical stresses on each of the connectors.

Furthermore, the hot brazing method includes a risk of damage to the connector and the electronic components nearby on the PCB when these connectors are more bulky and solid.

There is therefore a need for further enhancing the board-to-board connections, particularly in order to allow an installation with less, or even no soldering, to compensate for the high misalignment tolerances, to control the impedance with high microwave performance levels, to obtain connections for a significant height range with tolerances in displacement and in compression that are also significant, and to achieve maximum integration densities for a lighter weight.

The invention aims to address all or some of this need.

SUMMARY OF THE INVENTION

Thus, the subject of the invention, according to one of its aspects, is a coaxial microwave connector, intended in particular to link two printed circuit boards to one another, of central axis (X) comprising:

a first connection element comprising a conductive body, forming a ground contact, and a conductive rod forming a central contact arranged inside the ground contact;

a second connection element comprising a conductive body, forming a ground contact, a conductive rod forming a central contact arranged inside the ground contact; the ground and central contacts of the second connection element being free to be displaced, along the central axis (X), relative to those of the first connection element, between a configuration of disconnection, and a configuration of connection in which the first and the second connection elements are intended to establish an electrical ground contact and a central electrical contact between the two PCBs;

at least one flexible electrically insulating washer, which both allows the coaxial mechanical holding between each central contact inside the ground contact of the first or of the second connection element, and makes it possible to establish a mechanical pressure between the end of the central contact and one of the two PCBs.

According to an advantageous embodiment, the coaxial connector comprises one or more elastic return means for establishing a mechanical pressure between the end of the ground contacts and the two PCBs, the elastic return means being independent of the insulating washers.

Preferably, each of the central contacts protrudes relative to its ground contact which surrounds it, in the configuration of disconnection of the connector.

According to an advantageous variant embodiment, each electrically insulating washer is mounted in an internal groove inside the central contact that it holds.

Advantageously, each insulating washer has reliefs in the form of a star.

Preferably, each insulating washer is made of polyimide.

According to an advantageous installation configuration, the central contact and the ground contact of the first or of the second connection element are soldered onto one of the PCBs.

The invention also relates to a multichannel connector, comprising at least two coaxial connectors described previously, which extend around two parallel central axes.

According to an advantageous embodiment, the multichannel connector comprises a leaf arranged vertically and which protrudes laterally so as to attach the multichannel connector in a dedicated cell of an interface plate.

The subject of the invention is finally a connection module, intended in particular to link two printed circuit boards (PCB) to one another, comprising:

an interface plate comprising a plurality of through-cells, the interface plate being intended to be arranged between the two PCBs;

a plurality of connectors described previously, housed individually in a cell of the interface plate.

By virtue of the invention, it is possible to produce a board-to-board connection over a small distance within a wide range, typically lying between 3 and 20 mm, with tolerances on the distance between boards possibly reaching up to 30% of this distance.

The invention also makes it possible to reduce the bulk of each microwave link and therefore reduce the pitch between two board-to-board microwave links. The invention makes it possible to achieve integration pitches of the order of 2.5 mm and to significantly increase the density of the number of board-to-board links.

The bulk of this connection is very small and allows a very high density integration.

Furthermore, the connector has high tolerances to axial misalignment.

The "board-to-board" mounting using a coaxial connector according to the invention can be done without prior individual holding of the connector with one and/or the other of the printed circuit boards, in particular by brazing of the outer first conductive body to one of the boards, preferably the lower one. In other words, the integration of a connector according to the invention can be simple and rapid.

It is specified here that, obviously, the means for prior holding of the connector to one and/or the other of the boards are clearly distinct from the elastic return means, or, in other words, means for elastic mechanical holding of the central contacts and of the ground contacts making it possible to maintain the distance between boards in order to conserve the electrical connection.

The contact force between each end of the central contacts and one of the two PCBs to be linked is constant whatever the distance with the PCB, through the deflection of the electrically insulating washers which make it possible to maintain a separation between the two central contacts and a pressure at the free end of each of them. That is very advantageous, particularly in radar applications (Doppler effect).

Similarly, the contact force between each end of the ground contacts and one of the two PCBs to be linked is constant whatever the distance with the PCB by virtue of the elastic return means. In addition, these elastic return means are shrewdly arranged on the outside relative to the microwave line and absolutely do not disturb the transmitted signal.

Furthermore, these forces on the ground contacts on the one hand and those on the central contacts on the other hand are independent by virtue of the two mutually independent systems, the elastic return means on the outside for the ground contacts, and the elastic washers for the central contacts. That guarantees a radiofrequency contact on the PCB that is constant and uniform.

The outer diameter of each coaxial connector can be very small, typically of the order of 2.5 mm, which makes it possible to achieve a high integration density. Furthermore, since the outer ground contacts are completely closed radially on themselves, i.e. over 360°, the electrical contacts are uniform over all the circumference of the contacts on the PCBs. The forces applied on the ground contacts by the elastic return means (helical springs, with blades) make it possible to maintain this uniformity, whatever the conditions of use, particularly during mechanical vibrations. The crosstalk and electromagnetic Interference (EMI) shielding performance levels are greatly enhanced, particularly in the multichannel versions of the connectors.

A plurality of coaxial connectors according to the invention is incorporated in through-cells of a dedicated interface plate to be arranged between the two PCBs to be linked. More specifically, the coaxial connectors are positioned in the through-cells of the interface plate before positioning the last of the two PCBs.

In fact, it is advantageously possible to provide a very tight-fitted form of cell so that the means for elastic mechanical holding of the ground contacts (helical springs, blade springs) are in contact with the inner wall of the cell and the friction is sufficient to hold the connector in the cell, even without the presence of a PCB.

A connection system with interface plate housing a plurality of coaxial connectors according to the invention offers excellent crosstalk performance levels, each transmission channel being in its dedicated cell while being insulated from the others.

The applications considered for a coaxial connector according to the invention are numerous, and those that can be cited include military and civilian radar applications, space (observation satellites), arrays of telecommunications antennas, particularly for the very high bit rate 5G.

DETAILED DESCRIPTION

Other advantages and features of the invention will emerge more clearly on reading the detailed description of exemplary implementations of the invention given in an illustrative and nonlimiting manner with reference to the following figures in which.

Figure 7A:
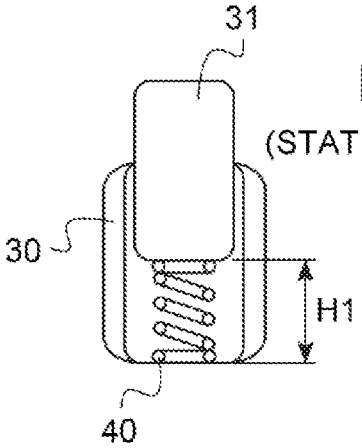
Figure 7B:
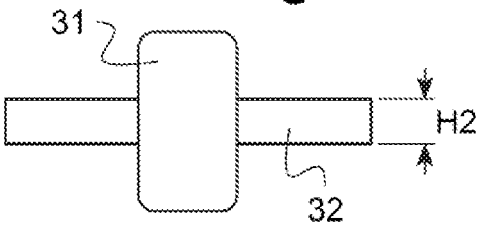
Figure 11:
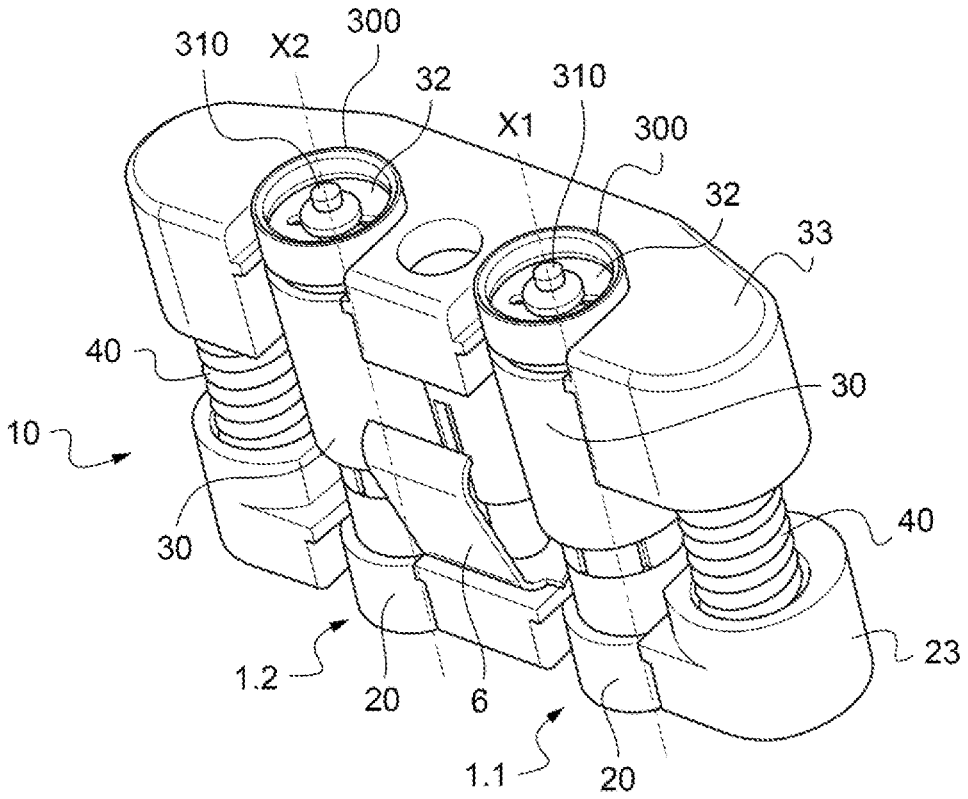

FIGS. 7A and 7B schematically represent the minimum height needed for the central line of a coaxial connector respectively according to the state of the art and according to the invention;

FIGS. 8A and 8B schematically represent, by plan view, a coaxial connector respectively according to the state of the art and according to the invention with the zones of generation of the return forces that it generates symbolized;

FIGS. 9A and 9B repeat the diagrams of FIGS. 8A and 8B, but for a plurality of coaxial connectors;

FIG. 10 schematically represents another optimal arrangement of a plurality of coaxial connectors according to the invention with, for each of the zones of generation of the return forces that it generates symbolized;

FIG. 11 represents, by perspective view and in partial cross section, an example of multichannel coaxial microwave connector according to the invention.

Throughout the present application, the terms "vertical", "lower", "upper", "down", "up", "below" and "above" should be understood with reference to a coaxial microwave connector in vertical configuration with the connection element 2 below the connection element 3.

Similarly, the terms "inner" and "outer" should be understood relative to the central axis X of the coaxial connector: an inner wall is situated inside the connector and turned towards the axis, while an outer wall is turned in an opposite direction, toward the outside of the connector 1.

In the interests of clarity, one and the same numeric reference is used for one and the same element of a coaxial connector according to the state of the art and of a coaxial connector according to the invention.

A coaxial connector 1 according to the invention which will be described is capable of conveying microwave signals, that is to say signals within the range of frequencies lying between 1 GHz and 20 GHz, even up to 100 GHz, in particular equal to 40 GHz.

Figure 1:
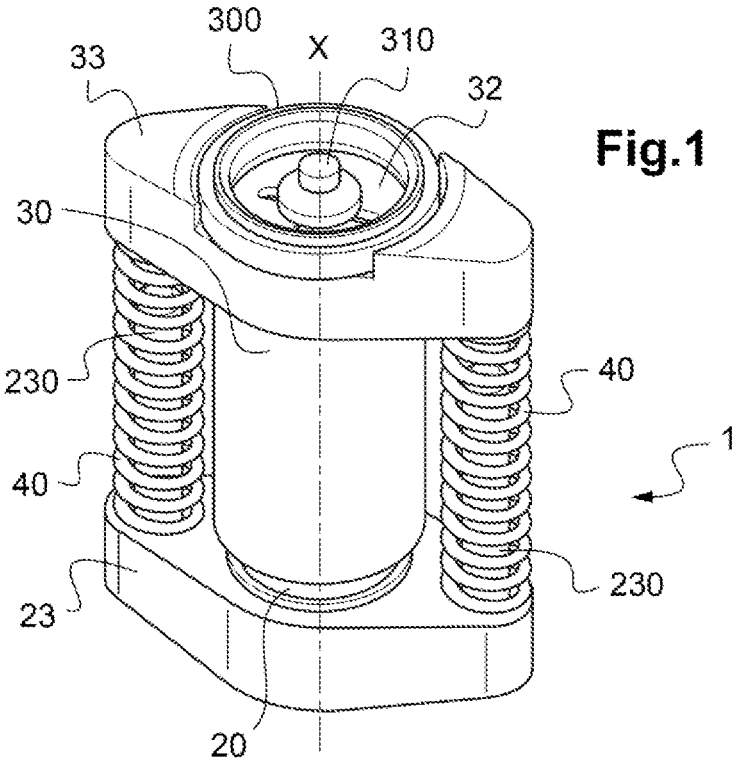
FIG. 1 represents, by perspective view, a first example of coaxial microwave connector according to the invention.

FIG. 1 shows an example of coaxial microwave connector 1 according to the invention.

A coaxial microwave connector 1 according to the invention which extends around its central axis X, is provided to link two printed circuit boards separated by a board-to-board distance which can be small, but within a wide range, typically lying between 3 and 20 mm, with relatively high tolerances of the order of 30%.

FIGS. 1 to 5 show a coaxial microwave connector 1 comprising a first connection element 2, suitable for cooperating with a second connection element 3.

The second connection element 3 is free to be displaced, along the central axis X, relative to the first connection element 2, between a configuration of disconnection, and a configuration of connection in which the connection elements 2, 3 establish a central electrical contact and a ground contact between two printed circuit boards (PCB).

In the configuration of connection, the central and ground contacts of the coaxial connector 1 establish the electrical contacts with compression.

The first connection element 2 comprises a conductive body 20, which constitutes a ground contact, a conductive rod 21 which constitutes a central contact and at least a flexible electrically insulating washer 22, which ensures in particular the coaxial mechanical holding of the central contact 21 inside the ground contact 20, and also the transferring of the forces necessary to the compressing of the two bottom 210 and top 310 rigid ends and of the conductive body 20.

The conductive body 20, the conductive rod 21 and the flexible insulating washer 22 each exhibit overall a symmetry of revolution about the axis X of the connector 1. This insulating washer 22 also ensures an electrical insulation function in the microwave transmission line. However, the main insulator is still the air, which makes it possible to achieve an extremely low level of microwave losses.

The body 20 has a general form, from its bottom end 200, of a hollow cylinder of circular section, centered around the axis X which flares out in the form of a truncated cone to its top end 201 formed by a plurality of petal-shaped elements.

The rigid bottom end 200 of the body 20 is intended to be in electrical and mechanical contact with a first of the printed circuit boards (PCB).

The conductive rod 21 has a dog point-form rigid bottom end 210 also intended to come into electrical and mechanical contact with the first PCB, and a top end 211 in the form of a bush.

The second connection element 3, for its part, comprises a conductive body 30, which constitutes a ground contact, a conductive rod 31 which constitutes a central contact and at least one flexible electrically insulating washer 32, which ensures in particular the coaxial mechanical holding of the central contact 31 inside the ground contact 30.

The conductive body 30, the conductive rod 31 and the flexible insulating washer 32 each have overall a symmetry of revolution about the axis X of the connector 1.

The body 30 has a general form of a rigid hollow cylinder of circular section centered around the axis X from its top end 300, to its bottom end 301.

The rigid top end 300 of the body 30 is intended to be in electrical and mechanical contact with the second of the printed circuit boards (PCB).

The conductive rod 31 is in the form of a rigid shaft which has a dog point-form rigid bottom end 310 intended also to come into electrical and mechanical contact with the first PCB.

In the assembled configuration of the coaxial connector, illustrated in FIGS. 1 to 5, the rigid axis 31 is inserted with contact into the bush 21.

Similarly, the electrical contact is guaranteed solely by the top end 201 of the ground contact 20 below, at the end of the prestressed petals in the bottom end 301 of the ground contact 31 above. The play of the tapered part formed by the petals 201 inside the end 301 of the ground contact 30 forms a kind of ball joint link.

The microwave signal is then transmitted between the central line formed by the central contact 31 inserted into the bush 21 and the ground line formed by the ground contact 30 inserted into the other ground contact 20.

In a configuration in which the two PCBs to be linked are not perfectly parallel, this ball joint link allows the geometrical axes of the contacts 2, 3 to not be perfectly aligned and form an angle between them, without adversely affecting the quality of the electrical contacts on each PCB.

According to the invention, the set of contacts is dimensioned such that each of the central contacts 21, 31 necessarily protrudes relative to its ground contact 20, 30 which surrounds its, when the coaxial connector 1 is in configuration of disconnection, that is to say at rest, or, in other words, without mechanical compression stress for a link between two PCBs.

Consequently, according to the invention, the coaxial connector 1 is provided with two independent, elastic return-based, contact pressing systems, i.e. one to guarantee the mechanical pressing of the ground contacts 20, 30 against the two PCBs to be linked, the other for the mechanical pressing of the central contacts 21, 31 against the two PCBs.

According to the invention, the mechanical pressure for each of the electrical contacts between the end of a central contact and one or other of the PCBs is guaranteed by the flexing of the electrically insulating washers.

Thus, the end 210 of the central contact 21 on the first PCB is guaranteed by the flexing of at least one electrically insulating washer 22, whereas the end of the central contact 31 on the second PCB is guaranteed by the flexing of at least one electrically insulating washer 32.

Advantageously, the electrically insulating washers 22, 32 are mounted in internal grooves 202, 302 provided for this purpose inside the central contacts.

Preferably, the insulating washers 22, 32 have reliefs in the form of a star which allows them to avoid any undesirable deformation when they are bent by flexing to obtain the desired pressing of the central contacts 21, 31. Thus, in the long run, the star-form washers 22, 32 do not undergo excessive fatigue and/or tearing and their central hole thus perfectly holds the central contact 21, 31 in axial position. Any cutting which would make it possible to linearize the fatigue zones linked to the flexing of the washers 22, 32 would also be advantageous.

Also preferably, the electrically insulating washers 22, 32 are made of polyimide, of Kapton® type. This material is perfectly suited to all the thermal, electrical insulation and mechanical properties for the dual function both of coaxial mechanical holding of the central contacts and of flexibility for the mechanical pressure for the electrical contact of the central contacts on the two PCBs to be linked.

Also, according to the invention, the mechanical pressure for each of the electrical contacts between the end of a ground contact and one or other of the PCBs is guaranteed by elastic return means based on distinct compression 4 of the insulating washers 22, 32 and arranged on the outside of the ground contacts 20, 30.

Figure 2:
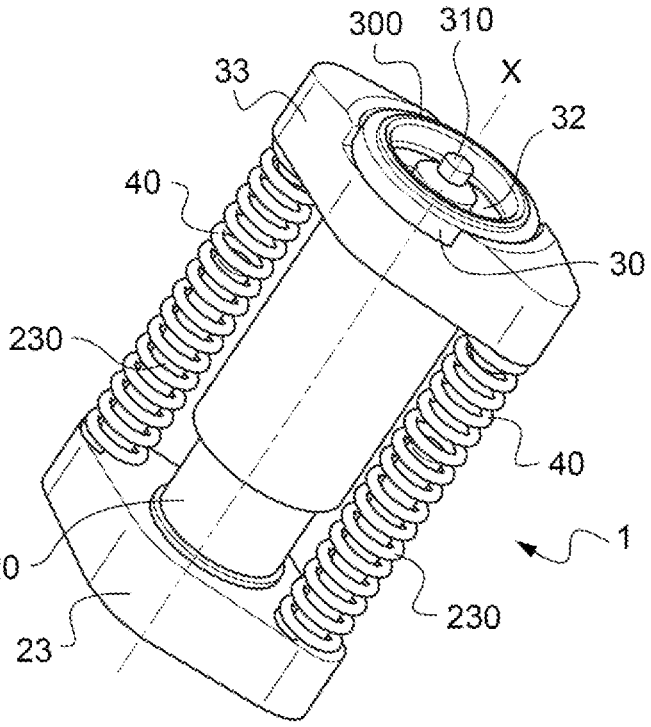
FIG. 2 is another perspective view of the connector according to FIG. 1.
Figure 2A:
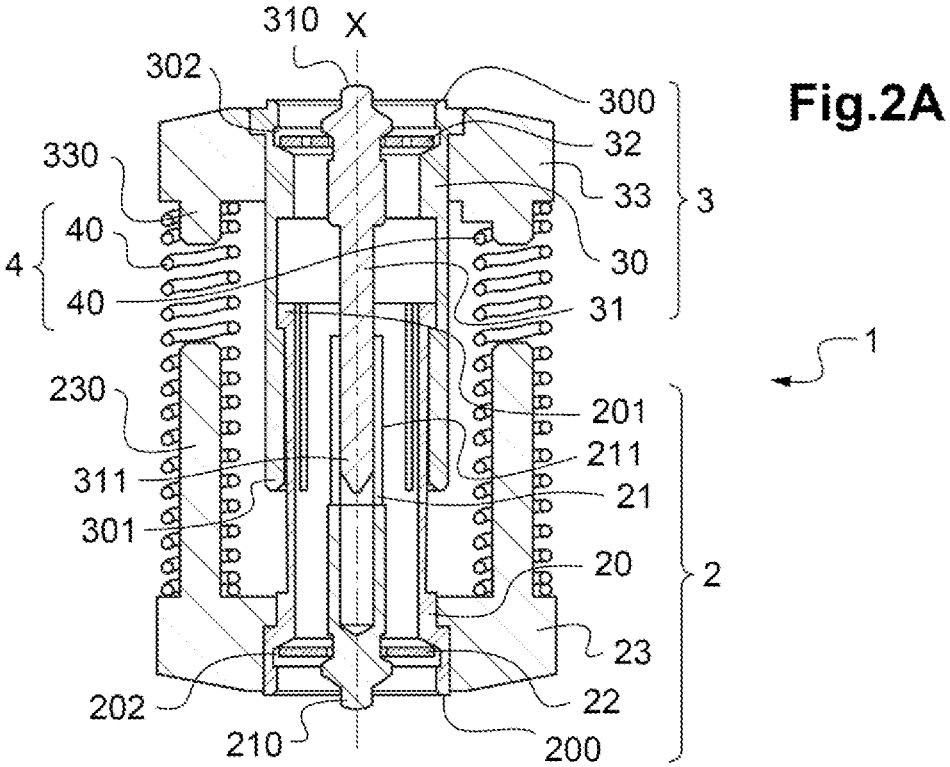
FIG. 2A is a longitudinal cross-sectional view of the connector according to FIGS. 1 and 2.
Figure 3:
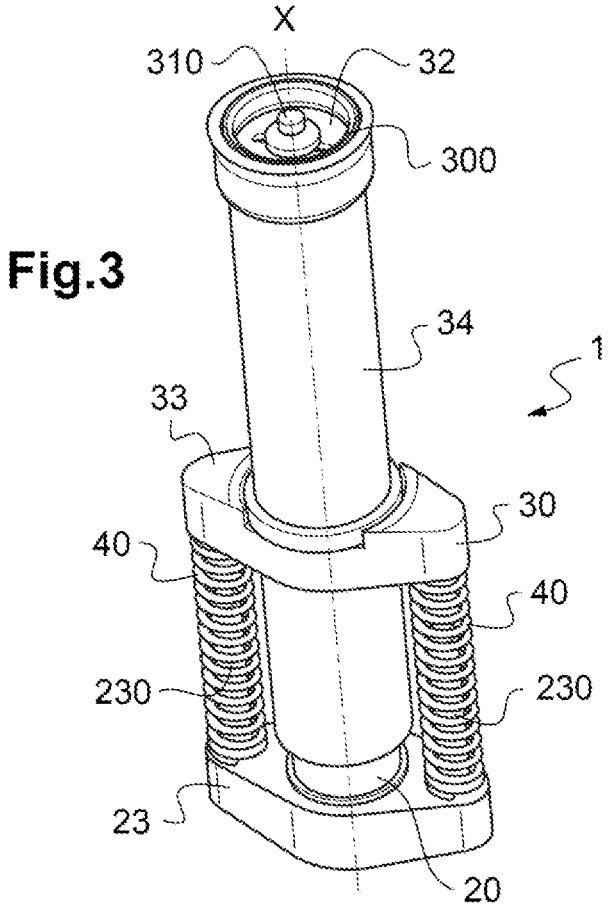
FIG. 3 is a perspective view of a variant of the coaxial connector according to FIGS. 1 to 2A.

In the examples illustrated in FIGS. 1 to 3, the compression means 4 are composed of two helical springs 40, arranged diametrically opposite relative to the ground contacts 20, 30. This arrangement makes it possible to guarantee a minimal bulk of the connection, and therefore a more dense integration, while conserving compression forces that are sufficient to guarantee the electrical performance levels of the connection.

More specifically, according to this embodiment, the coaxial connector 1 comprises two plates 23, 33 each coming to bear on an outer shoulder of a ground contact. One of the ends of each helical spring 40 comes to bear against one of the plates 23, and the other of the ends comes to bear against the other of the plates 33.

Advantageously, each plate 23, 33 comprises two holding rods 230, 330 around which the helical springs 40 are housed, in order to guide them.

Preferably, in the configuration of disconnection of the connector which corresponds to an absence of longitudinal forces on the contacts, the springs 40 are prestressed.

Figure 4:
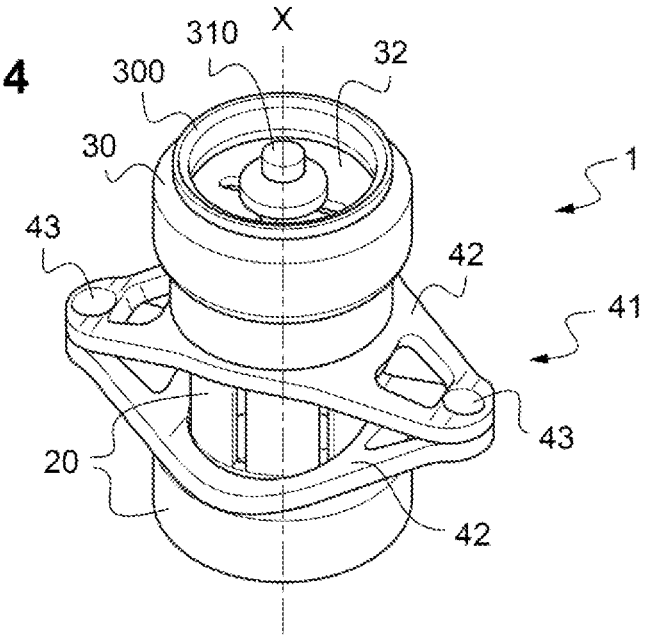
FIG. 4 represents, by perspective view, a second example of coaxial microwave connector, according to the invention.
Figure 5:
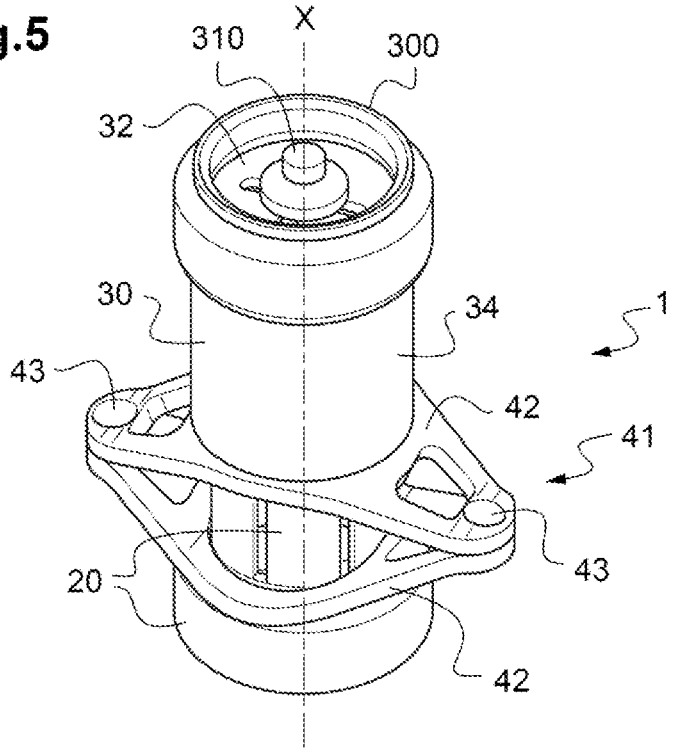
FIG. 5 is a perspective view of a variant of the coaxial connector according to FIG. 4.

As illustrated in FIGS. 4 and 5, a leaf spring 41 can be arranged instead of and in place of the two helical springs 40. More specifically, the spring 41 comprises two flexible leaves 42 arranged head-to-tail, that is to say with their bends in opposite directions, and which are linked to one another at their ends 43. Each of the flexible leaves 42 bears directly against one of the two ground contacts 20, 30.

A leaf spring 41 has the advantage of dispensing with the use of the bearing plates 23, 33 of the helical springs 40.

According to an advantageous variant embodiment, illustrated in FIGS. 3 and 5, when the board-to-board distance of the two PCBs to be linked is greater, it is possible to provide for each ground contact 20, 30 to be provided with an extension 34 which is of a piece therewith.

To produce a board-to-board link, a plurality of coaxial connectors 1 which have just been described are implemented.

For this, each coaxial connector 1 is housed individually in a through-cell of an interface plate, to be arranged at the interface between the two PCBs to be linked.

Figure 6:
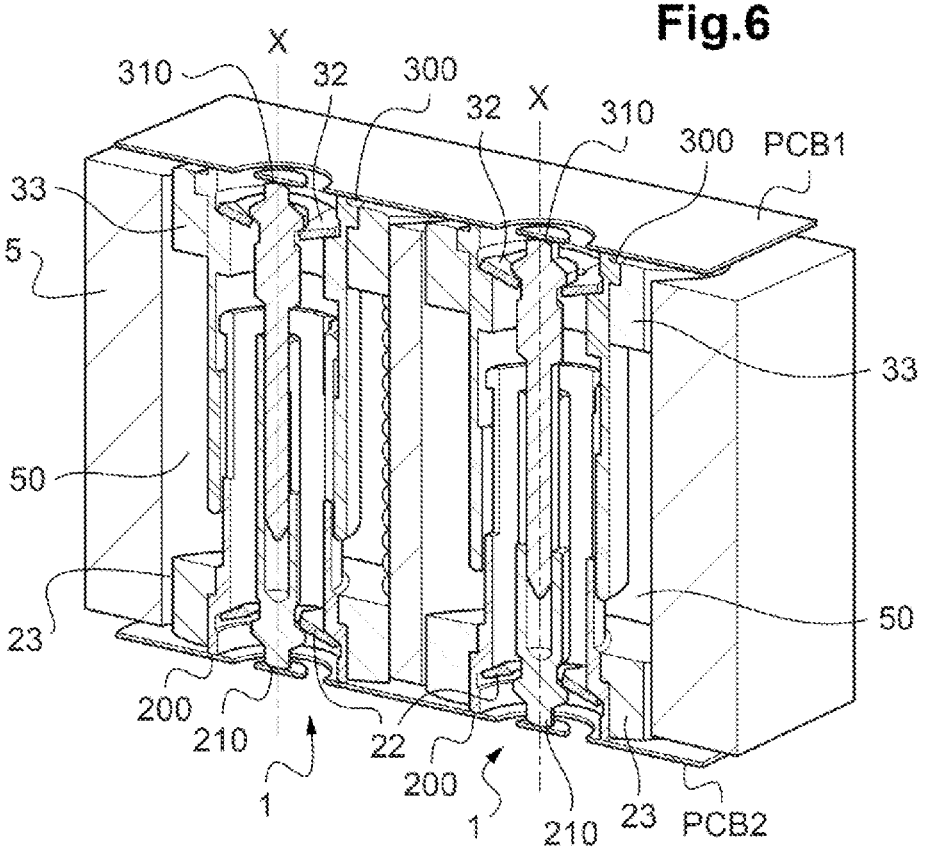
FIG. 6 represents, by longitudinal cross-sectional view, two single-channel coaxial connectors according to the invention in their respective cells of an interface plate arranged between two PCBs to be linked.

An example of parallel housing of two identical coaxial connectors 1 according to the invention is shown in FIG. 6.

Each of the two connectors 1 is housed in a cell 50 of an interface plate 5 between the two printed circuit boards, PCB1, PCB2 to be linked.

The outer shape of the connector 1 depends on the cell 50 in which each connector 1 comes to be housed.

A rhomboid form of the bearing plates 23, 33 or even of a leaf spring 41, as illustrated in FIGS. 1 to 5, is advantageous, because it allows for a saving in terms of bulk and therefore, ultimately, it increases the integration density of the plurality of coaxial connectors 1.

The arrangement on the outside of the elastic return means, i.e. the springs 4, for the ground contacts, makes it possible to have a very small bulk in the axis at right angles to the alignment of the springs relative to a solution according to the state of the art with a single coaxial spring inside, like that of the U.S. Pat. No. 7,416,418. On this axis of smallest bulk, the connector can be inserted in walls of an interface panel/plate 5 of very small thickness, typically of the order of 3 mm.

The inner wall of the cells 50 is used for lateral guidance of the helical springs 40, but also for the leaf springs 41.

In practice, the form of the cells 50 can be fitted as closely as possible to those of the springs 4 such that the latter are in contact individually with the inner wall of a cell 50 with a friction that is sufficient to hold each connector 1 in the cell 50, and do so even in the absence of PCB.

That is advantageous in mounting because it is possible to have an assembled module, i.e. an interface plate 5 in the cells 50 of which the coaxial connectors 1 are mounted and held by friction.

FIG. 7B schematically represents the height of a central contact 31 of a coaxial connector 1 according to the invention with an insulating washer 32 of height H2.

FIG. 7A schematically represents the height of a central contact 31 of a coaxial connector 1 according to the state of the art with a central helical spring 40 of height H1 in its rest state.

Ultimately, the saving in height for each end induced by the invention is equal to H2-H1.

Thus, by virtue of the invention, by reducing the height of the central line, the board-to-board distance is reduced compared to the connectors of the prior art in which the helical spring arranged in the axis of the central contact forms a piston therewith.

FIG. 8A schematically represents a coaxial connector according to the state of the art with the coaxial location, around the ground 30 and central 31 contacts, of the single zone Z of generation of the return forces.

FIG. 8B schematically represents a coaxial connector according to the invention with a location in two zones Z1, Z2 of generation of the return forces, because of the outer arrangement of the elastic return means 4 of the ground contact 30.

FIGS. 9A and 9B repeat FIGS. 8A and 8B for a plurality of coaxial connectors.

By comparing the configuration according to the invention (FIGS. 8B, 9B) to that according to the state of the art (FIGS. 8A, 9A), it clearly emerges that, for the same transverse connector dimensions (outer diameters of the ground contacts 30), the invention provides an increased density of coaxial connectors in the plane parallel to the PCBs to be linked.

It can also be seen in FIG. 9B that it is possible, by orienting the coaxial connectors according to the invention relative to one another, to go as far as having the ground contacts 30 arranged almost edge-to-edge.

FIG. 10 shows another arrangement with optimized bulk of a plurality of connectors according to the invention for a board-to-board link.

Such a link between two PCBs takes place with an assembled module according to the invention, as follows.

An assembled module is put in place as explained above, by bringing the two PCBs to be linked together on either side.

The set of central contacts 21, 31 is then placed under mechanical pressure by the flexural deformation of the insulating washers 22, 32, until the end 210, 310 of the central contacts comes into the plane defined by the ends 200, 300 of the ground contacts 20, 30.

All the ground 20, 30 and central 21, 31 contacts are then in mechanical and electrical contact with the two PCBs.

Then, the helical 40 or leaf springs 41 are placed under mechanical pressure, until the dimension of spacing of the PCBs specified with the desired fitting tolerance is obtained.

Thus, with the coaxial connectors 1 and an interface plate with cells for housing the coaxial connectors 1, it is possible to produce a board-to-board connection without soldering.

Each coaxial connector 1 illustrated in FIGS. 1 to 5 is a single-channel connector.

It is possible to envisage multichannel coaxial connectors, in particular a two-channel connector 10, as illustrated in FIG. 11.

This two-channel connector 10 comprises two coaxial connectors 1.1, 1.2 such as those which have been described previously, which extend around two parallel central axes X1, X2 and between bearing plates 23, 33 common to the two connectors.

A leaf 6 arranged vertically and which protrudes laterally from one and/or the other of the bearing plates 23, 33 makes it possible to attach the multichannel connector 10 in its dedicated cell of the interface plate, if at least one of two PCBs to be linked is not arranged below the connector 10.

Other variants and enhancements can be provided without in any way departing from the scope of the invention.

Thus, if while, in the examples illustrated, the coaxial holding of a central contact 21, 31 inside its ground contact 20, 30 is ensured by an electrically insulating washer 22, 32, it is perfectly possible to envisage doubling them, in particular according to the pressure forces of the central contacts 21, 31 that is required to be assigned to them.

Also, while, in the examples illustrated, the bearing plates 23, 33 of the helical springs 40 are parts that are clearly distinct from the ground contacts, it is also perfectly possible to envisage them each being made of a single piece with one of the ground contacts 20, 30.

While the board-to-board link which has been described with coaxial connectors 1 according to the invention and an interface plate with cells for housing connectors, makes it possible to produce a robust and complete board-to-board link without soldering, it is also possible to envisage performing a soldering of the contacts on one side, that is to say on one of the two PCBs to be linked.

It is also possible to envisage wiring one of the sides of the connector while the other side will be connected to a PCB.

The expression "comprising one" should be understood to be synonymous with "comprising at least one", unless specified otherwise.

The invention claimed is:

1. A coaxial microwave connector, of central axis (X) comprising a first connection element comprising a conductive body, forming a ground contact, and a conductive rod forming a central contact arranged inside the ground contact;

a second connection element comprising a conductive body, forming a ground contact, a conductive rod forming a central contact arranged inside the ground contact, the ground and central contacts of the second connection element being free to be displaced, along the central axis (X), relative to the ground contact and the central contact of the first connection element, between a configuration of disconnection, and a configuration of connection in which the first and the second connection elements are intended to establish an electrical ground contact and a central electrical contact between the two PCBs;

at least one flexible electrically insulating washer, which both allows for a coaxial mechanical securing between each central contact inside the ground contact of the first or of the second connection element, and makes it possible to establish a mechanical pressure between an end of the central contact and one of the two PCBs.

2. The coaxial connector according to claim 1, comprising one or more elastic return means for establishing a mechanical pressure between an end of the ground contacts and the two PCBs, the elastic return means being independent of the insulating washers.

3. The coaxial connector according to claim 1, wherein the central contact of the first connection element and the central contact of the second connection element protrude relative respectively to the ground contact of the first connection element and to the ground contact of the second connection element, in the configuration of disconnection of the connector.

4. The coaxial connector according to claim 1, wherein each electrically insulating washer is mounted in an internal groove inside the central contact that the electrically insulating washer holds.

5. The coaxial connector according to claim 1, wherein each insulating washer has reliefs in a form of a star.

6. The coaxial connector according to claim 1, wherein each insulating washer is made of polyimide.

7. The coaxial connector according to claim 1, wherein the central contact and the ground contact of the first or of the second connection element are soldered onto one of the PCBs.

8. A multichannel connector, comprising at least two coaxial connectors according to claim 1, which extend around two parallel central axes (X1, X2).

9. The multichannel connector according to claim 8, comprising a leaf spring arranged vertically and which protrudes laterally so as to attach the multichannel connector in a dedicated cell of an interface plate.

10. A connection module comprising:

an interface plate comprising a plurality of through-cells, the interface plate being intended to be arranged between two PCBs;

a plurality of coaxial connectors according to claim 1, housed individually in a cell of the interface plate.

11. A method of using the coaxial connector according to claim 1, the method comprising:

linking two printed circuit boards (PCBs) to one another by using the coaxial connector.

* * * * *